US010584528B2

(12) United States Patent
Anderson

(10) Patent No.: US 10,584,528 B2
(45) Date of Patent: Mar. 10, 2020

(54) END CAP FOR A RAIL FOR A WINDOW COVERING

(71) Applicant: Hunter Douglas, Inc., Pearl River, NY (US)

(72) Inventor: Richard N. Anderson, Whitesville, KY (US)

(73) Assignee: Hunter Douglas Inc., Pearl River, NY (US)

( * ) Notice: Subject to any disclaimer, the term of this patent is extended or adjusted under 35 U.S.C. 154(b) by 161 days.

(21) Appl. No.: 15/695,084

(22) Filed: Sep. 5, 2017

(65) Prior Publication Data

US 2017/0362886 A1 Dec. 21, 2017

Related U.S. Application Data

(63) Continuation of application No. 14/685,646, filed on Apr. 14, 2015, now Pat. No. 9,759,008, which is a continuation-in-part of application No. 14/089,861, filed on Nov. 26, 2013, now Pat. No. 9,357,868.

(60) Provisional application No. 61/873,055, filed on Sep. 3, 2013, provisional application No. 61/734,048, filed on Dec. 6, 2012.

(51) Int. Cl.

| | |
|---|---|
| ***E06B 9/38*** | (2006.01) |
| ***E06B 9/17*** | (2006.01) |
| ***E06B 9/388*** | (2006.01) |
| ***E06B 9/262*** | (2006.01) |
| ***E06B 9/322*** | (2006.01) |
| *E06B 9/24* | (2006.01) |

(52) U.S. Cl.

CPC ..... *E06B 9/17007* (2013.01); *E06B 9/262* (2013.01); *E06B 9/322* (2013.01); *E06B 9/388* (2013.01); *E06B 2009/2441* (2013.01); *E06B 2009/3222* (2013.01); *Y10T 16/372* (2015.01)

(58) Field of Classification Search

CPC ..... Y10T 16/3797; E06B 9/17007; E06B 9/17023; E06B 9/17046; E06B 9/42; B65D 2543/00009; B65D 2543/00018; B65D 2543/0037; B65D 2543/00398; B65D 2543/00592; B65D 2543/00601; B65D 2543/00611; B65D 2543/0062; B65D 2543/00648; B65D 2543/007112; B65D 2543/00722; B65D 43/02; B65D 43/0204; B65D 43/0214; A47H 1/14; A47H 2/00; E04H 17/00; E04H 2017/006

See application file for complete search history.

(56) References Cited

U.S. PATENT DOCUMENTS 1,476,160 A * 12/1923 Kirsch ..... E06B 9/50 160/23.1
1,491,325 A * 4/1924 Thomas, Jr. ..... H02G 3/083 138/89

(Continued)

FOREIGN PATENT DOCUMENTS

| | | |
|---|---|---|
| EP | 0192867 | 9/1986 |
| WO | WO2012/154871 | 11/2012 |

OTHER PUBLICATIONS

Australian Office Action issued in corresponding Application No. 2018203518 dated Feb. 28, 2019 (3 pages).

*Primary Examiner* — Johnnie A. Shablack
(74) *Attorney, Agent, or Firm* — Dority & Manning, P.A.

(57) ABSTRACT

An end cap for use on a rail for a covering for an architectural opening. At least one securement leg secures the end cap to the rail.

22 Claims, 15 Drawing Sheets

(56) References Cited

U.S. PATENT DOCUMENTS 2,618,329 A 11/1952 Nelson
2,623,581 A 12/1952 Nelson
2,637,382 A 5/1953 Nelson
2,860,699 A * 11/1958 Braun ..... E06B 9/388 160/173 R
3,220,469 A * 11/1965 Oehmig ..... E06B 9/52 160/380
3,724,525 A * 4/1973 Boneck ..... A47H 2/00 160/28
3,903,573 A 9/1975 Wilson
3,928,897 A 12/1975 Tombu
4,101,226 A 7/1978 Parisien
4,177,853 A 12/1979 Anderson et al.
4,425,955 A * 1/1984 Kaucic ..... E06B 9/361 160/168.1 V
4,638,532 A 1/1987 Yang et al.
4,647,488 A 3/1987 Schnebly et al.
4,662,596 A 5/1987 Haarer
4,690,192 A * 9/1987 Stilling ..... E04H 15/04 160/395
4,899,797 A * 2/1990 Green ..... E06B 9/52 160/380
5,127,458 A 7/1992 Schaefer et al.
D333,936 S 3/1993 van der Zanden
5,242,004 A * 9/1993 Stilling ..... E04B 7/00 135/117
5,259,687 A * 11/1993 John ..... A47H 2/00 160/38
5,330,821 A * 7/1994 Lo ..... A47H 2/02 16/94 R
D349,624 S * 8/1994 Fraser ..... D6/577
5,421,556 A * 6/1995 Dodge ..... E04H 17/20 256/1
5,655,590 A 8/1997 Bryant
5,702,090 A * 12/1997 Edgman ..... E04H 17/1421 256/19
5,765,621 A 6/1998 Bryant
5,788,224 A 8/1998 Platt
5,921,028 A * 7/1999 Marocco ..... E06B 7/086 49/403
6,059,004 A 5/2000 Oskam
6,062,292 A 5/2000 Bryant
6,095,222 A 8/2000 Voss
6,119,755 A * 9/2000 Oskam ..... E06B 9/262 160/84.02
6,148,894 A 11/2000 Judkins
D440,448 S 4/2001 Horsten
D443,456 S * 6/2001 Horsten ..... D6/580
D447,901 S * 9/2001 Horsten ..... D6/580
6,284,974 B1 * 9/2001 Albert ..... H02G 3/0418 174/68.3
6,408,923 B1 * 6/2002 Nien ..... E06B 9/36 160/168.1 V
6,483,027 B1 11/2002 Howard et al.
6,550,522 B1 4/2003 Lennon et al.
6,561,499 B2 * 5/2003 Lesenskyj ..... E04H 17/1439 256/65.01
6,609,702 B1 * 8/2003 Steffes ..... E04H 17/1434 256/1
6,691,760 B1 2/2004 Randall, Jr. et al.
6,804,921 B2 * 10/2004 Neylon ..... E04H 17/20 116/173
6,817,402 B1 11/2004 Fraczek et al.
6,899,156 B2 5/2005 Tyner
6,948,216 B2 9/2005 Gaudyn et al.
6,981,539 B2 1/2006 Fraczek
7,143,802 B2 12/2006 Strand et al.
D543,404 S 5/2007 Watkins et al.
7,216,686 B2 * 5/2007 Repp ..... A47H 2/00 160/38
7,360,573 B2 4/2008 Yu et al.
7,546,866 B2 6/2009 Strand et al.
D599,602 S * 9/2009 Chou ..... D6/580
7,766,068 B2 8/2010 Andersen
7,832,450 B2 11/2010 Brace et al.
7,857,034 B2 * 12/2010 Chou ..... E06B 9/50 160/323.1
8,016,013 B2 * 9/2011 Horvath ..... E06B 9/54 160/23.1
8,291,962 B2 * 10/2012 Allsopp ..... E04F 10/0633 160/383
8,480,048 B2 * 7/2013 Krantz-Lilienthal ... F16B 2/245 160/23.1
8,584,728 B2 11/2013 Truett et al.
8,807,190 B2 * 8/2014 Wills ..... E06B 9/42 160/23.1
8,857,494 B2 10/2014 Kirby et al.
8,931,540 B2 1/2015 Filko
9,314,125 B2 * 4/2016 Anthony ..... A47H 5/032
9,357,868 B2 6/2016 Anderson et al.
D762,462 S 8/2016 Anderson
D783,533 S * 4/2017 Tress ..... D13/133
9,759,008 B2 * 9/2017 Anderson ..... E06B 9/388
9,789,254 B2 * 10/2017 McLoughlin ..... A61M 5/20
10,036,200 B2 * 7/2018 Anderson ..... E06B 9/322
10,138,674 B2 * 11/2018 Hsu ..... E06B 9/32
2003/0010174 A1 1/2003 Biro
2003/0090123 A1 5/2003 Sturt
2004/0221970 A1 * 11/2004 Nien ..... E06B 9/323 160/173 R
2005/0103451 A1 * 5/2005 Nien ..... E06B 9/388 160/173 R
2005/0211394 A1 9/2005 Fraczek
2006/0048904 A1 3/2006 Gruner
2006/0196615 A1 9/2006 Yu et al.
2006/0278349 A1 12/2006 Lee
2006/0289126 A1 12/2006 Kollman et al.
2007/0039696 A1 2/2007 Strand et al.
2008/0035281 A1 * 2/2008 Kirby ..... E06B 9/42 160/265
2008/0099159 A1 5/2008 Nien
2008/0121350 A1 5/2008 Cheng
2008/0169068 A1 7/2008 Liang
2008/0265232 A1 10/2008 Terrels et al.
2008/0289774 A1 11/2008 Ying
2009/0120592 A1 5/2009 Lesperance
2011/0315329 A1 12/2011 Hong et al.
2012/0103537 A1 5/2012 Dogger
2012/0227912 A1 * 9/2012 Anderson ..... E06B 9/32 160/87
2012/0235105 A1 * 9/2012 Yasher ..... E04H 17/20 256/65.06
2012/0312486 A1 12/2012 Spray
2013/0192773 A1 * 8/2013 Wills ..... E06B 9/42 160/323.1
2013/0340949 A1 12/2013 Anderson et al.
2014/0096921 A1 4/2014 Kawai
2014/0158314 A1 6/2014 Anderson et al.
2014/0251558 A1 * 9/2014 Chou ..... E06B 9/42 160/323.1
2015/0020980 A1 * 1/2015 Franssen ..... E06B 9/382 160/84.01
2015/0020982 A1 1/2015 Anderson et al.
2015/0300041 A1 * 10/2015 Feeko ..... E04H 17/1421 256/65.12
2017/0362886 A1 * 12/2017 Anderson ..... E06B 9/388
2018/0155983 A1 * 6/2018 Franssen ..... E06B 9/327
2018/0163464 A1 * 6/2018 Mcneill ..... E06B 9/388
2018/0252032 A1 * 9/2018 Garcia Garcia ..... E06B 9/42

* cited by examiner

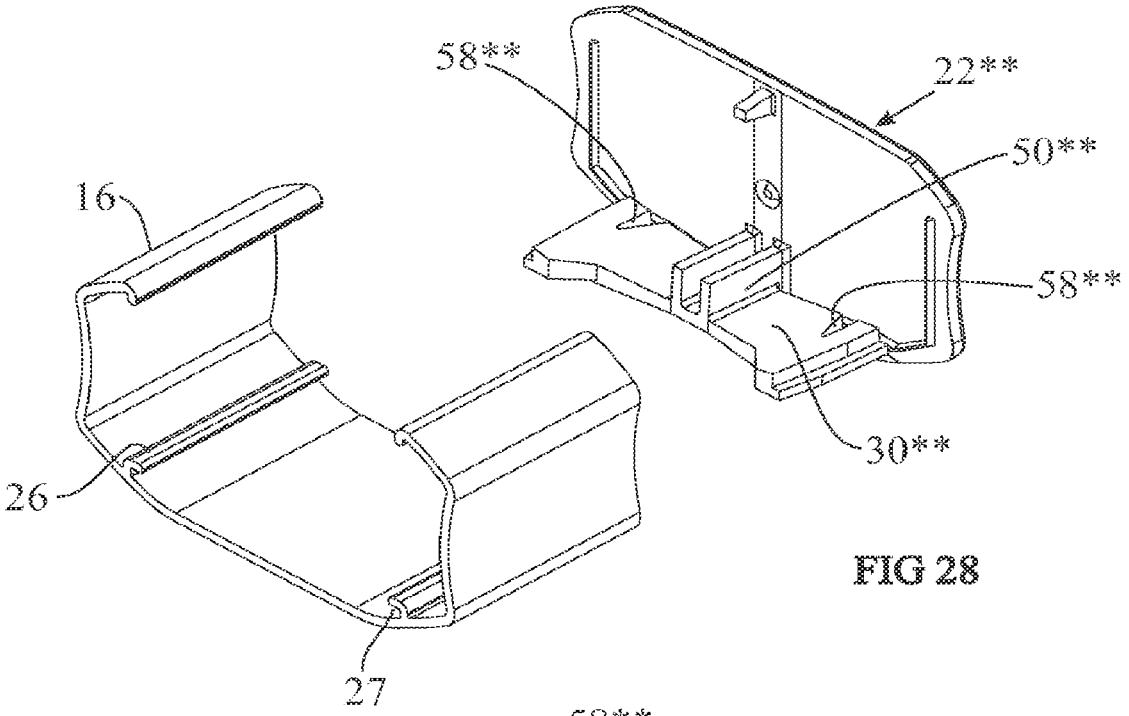
FIG 28
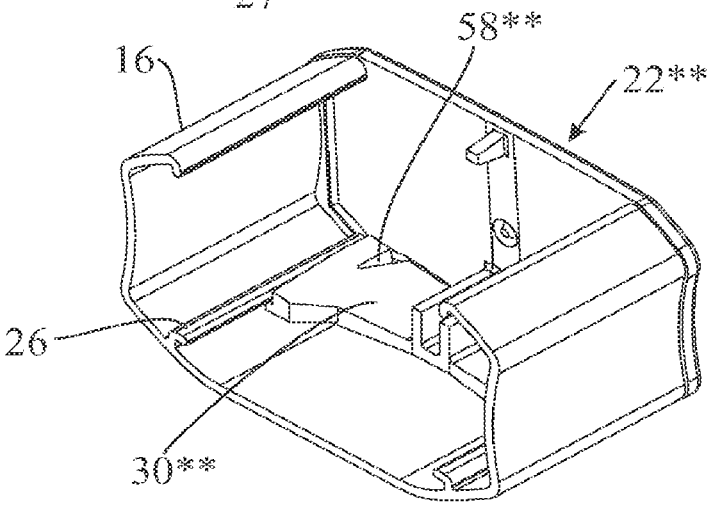
FIG 29
FIG 30
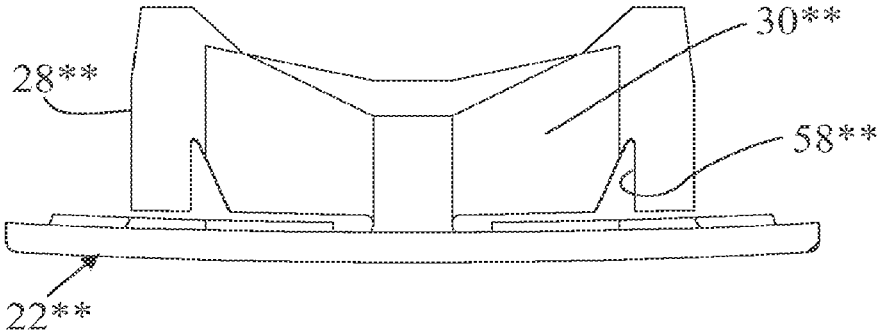

END CAP FOR A RAIL FOR A WINDOW COVERING

BACKGROUND

This application is a continuation of U.S. application Ser. No. 14/685,646, filed on Apr. 14, 2015, which is a continuation-in-part of U.S. application Ser. No. 14/089,861, filed Nov. 26, 2013, which, in turn, claims priority from U.S. Ser. No. 61/873,055, filed Sep. 3, 2013 and 61/734,048, filed Dec. 6, 2012, the disclosures of all of which are hereby incorporated by reference herein in their entirety for all purposes.

The present invention relates to an end cap for use on a rail for a window covering. More specifically, it relates to a removable end cap with a bias to ensure a tight fit against the end of the rail, In typical prior art end caps, securement means such as crush ribs have been used to ensure a tight fit against the end of a rail. While this is effective for single use applications, if the end cap needs to be removed, it usually is not possible to reuse the end cap and still have a tight fit that will ensure the end cap will not fall out.

SUMMARY

In one embodiment of the present invention, an end cap mounting arrangement is provided with the end cap having an arcuate cross-sectional shape which is flattened when the end cap is installed, creating a bias, which results in a releasable, reusable end cap with a tight fit against the end of a rail,

BRIEF DESCRIPTION OF THE DRAWINGS

FIG. 28 is a perspective view of a rail and end cap for another alternative embodiment, with the rail broken away;

FIG. 29 is a perspective view of the assembled rail and end cap of FIG. 28, with the rail broken away; and FIG. 30 is a plan view of the end cap of FIG. 28.

DESCRIPTION

Figure 1:
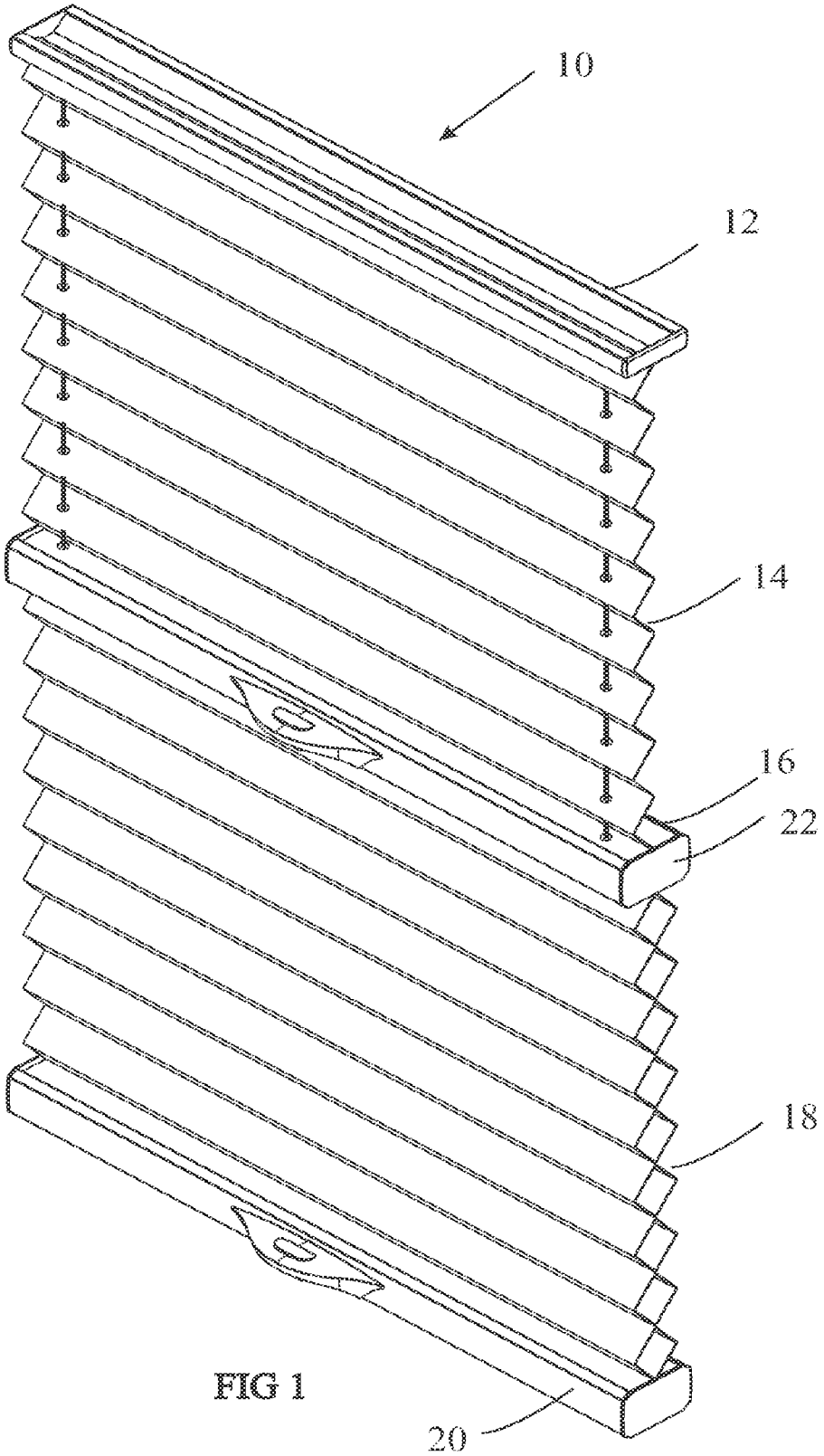
FIG. 1 is a perspective view of a window covering including a head rail, a pleated shade portion, an intermediate rail, a cellular shade portion, and a bottom rail.

FIG. 1 shows a window covering 10 including a head rail 12, a pleated shade portion 14, an intermediate rail 16, a cellular shade portion 18, and a bottom rail 20. Any one of the rails 12, 16, 20 (or all three of the rails) may house components (not shown) to assist the user in raising or lowering the window covering 10. The rails 12, 16, 20 are elongated and include end caps, such as the end cap 22 on the intermediate rail 16, which provide a pleasing, aesthetic finish to the rail 16, and provide access to any components housed in the rail 16 during assembly of the window covering 10 and also later on, during adjustment or replacement of the components housed in the rail 16. Of course, other types of window coverings, such as Venetian blinds, also have rails with end caps and may use the end cap mounting arrangement of this invention.

Figure 2:
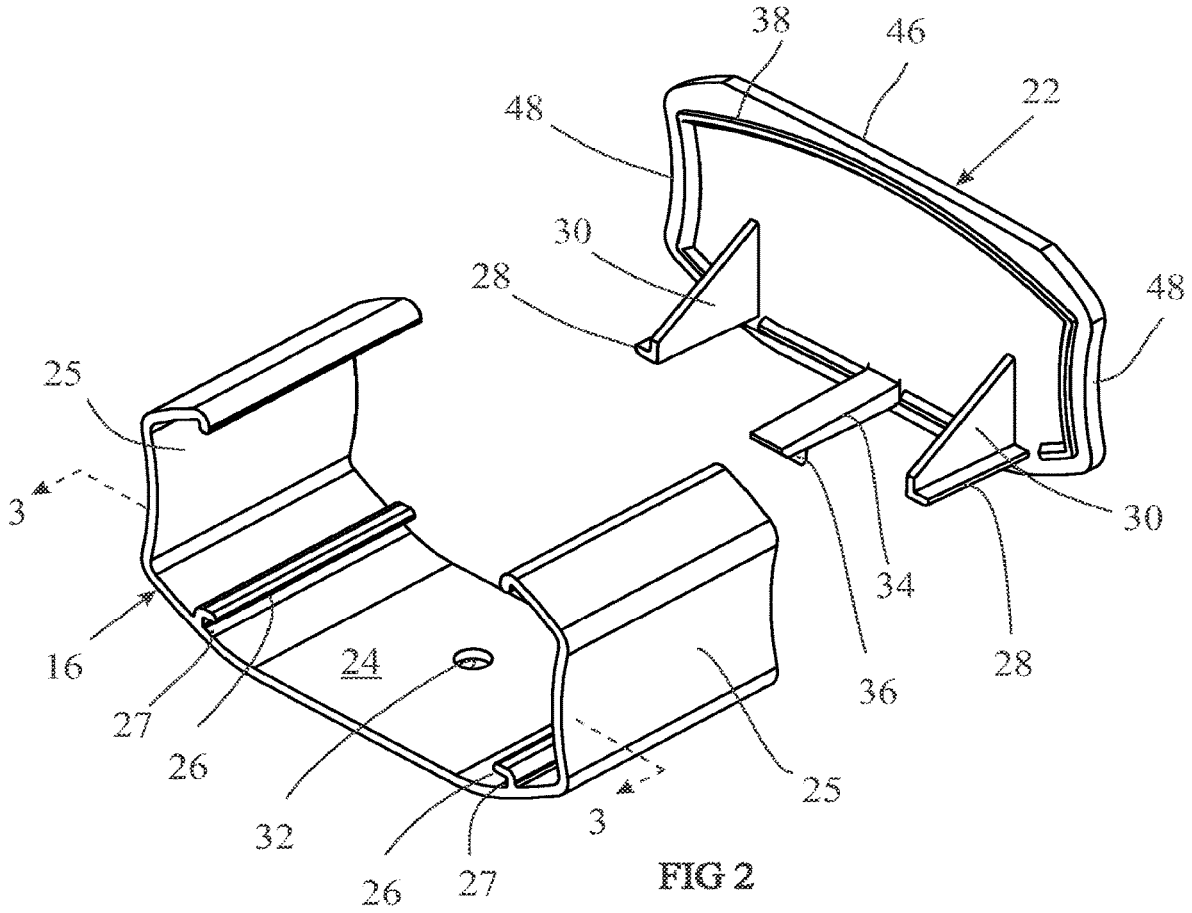
FIG. 2 is a perspective view of the intermediate rail and end cap of FIG. 1, with the rail broken away.
Figure 3:
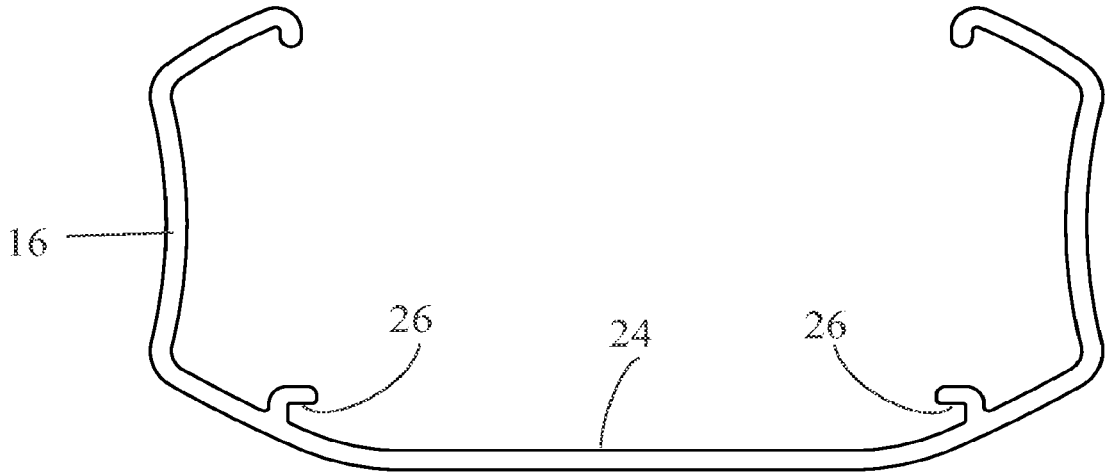
FIG. 3 is a section view along line 3-3 of FIG. 2.
Figure 4:
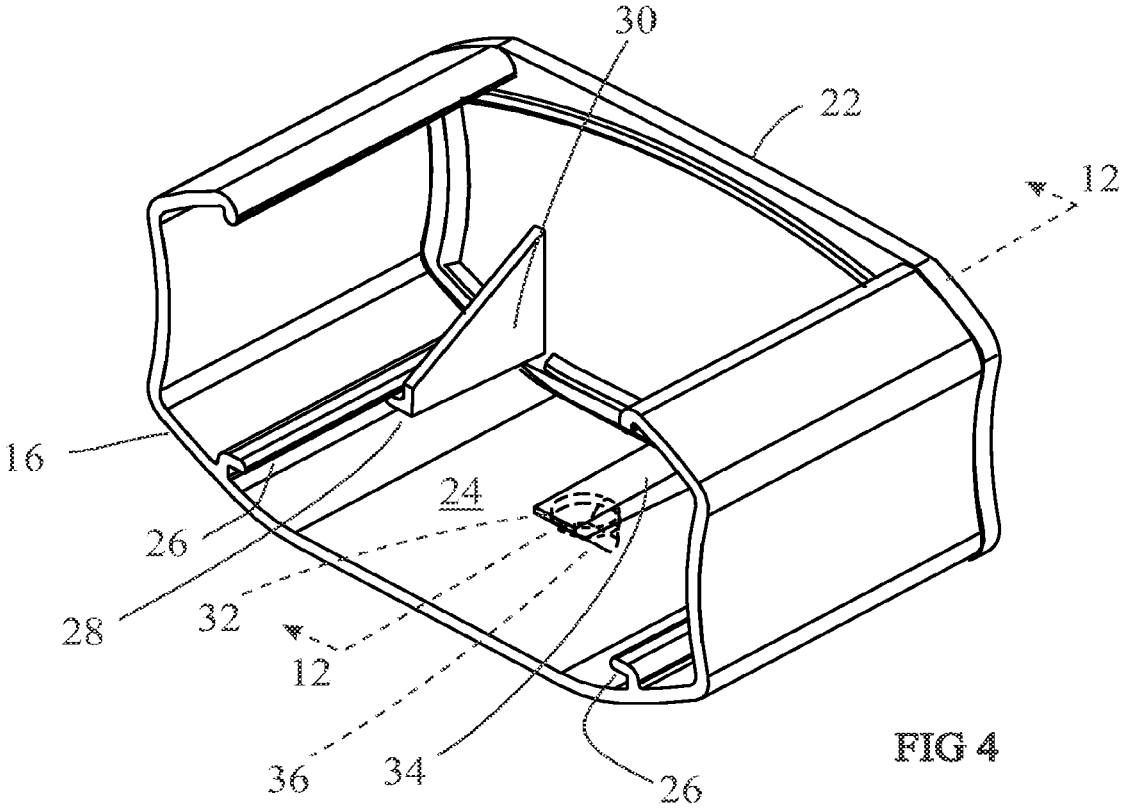
FIG. 4 is a perspective view of the assembled rail and end cap of FIG. 2, with the rail broken away and with the projection on the beam of the end cap and the corresponding through opening in the rail shown in phantom.
Figure 5:
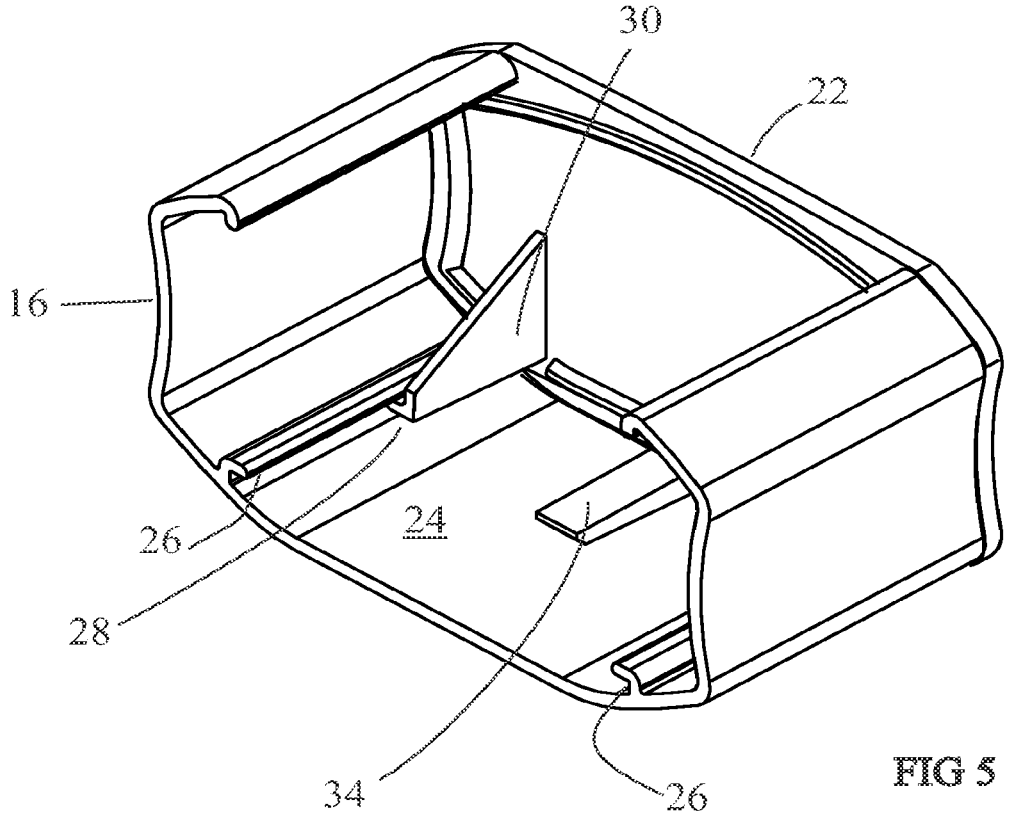
FIG. 5 is the same view as FIG. 4, but removing the phantom lines.

FIGS. 2-11 show the end cap 22 and rail 16 of FIG. 1 in more detail. Referring to FIGS. 2 and 3, the rail 16 has a "U"-shaped profile including an elongated base wall 24 and two elongated legs 25 projecting away from the base wall 24. The end of the rail 16 is flat, lying in a vertical plane. Two opposed tracks 26 project away from the inner surface of the base wall 24. These tracks 26 extend parallel to the longitudinal axis of the rail 16 and are designed and sized to slidingly receive mating wings 28 on corresponding outriggers 30 projecting from the inner surface of the end cap 22. The tracks 26 have a hook-shaped cross-section, projecting away from the base wall 24 and then inwardly, toward the central axis of the rail 16, forming a space 27 between the inwardly projecting portion and the base wall 24. The mating wings 28 project outwardly, away from the central axis of the rail 16, and are received in the respective spaces 27 formed by the tracks 26.

The rail 16 also defines an opening 32 through the base wall 24 of the rail 16. The opening 32 is located between the tracks 26 near the end of the rail 16.

Figure 6:
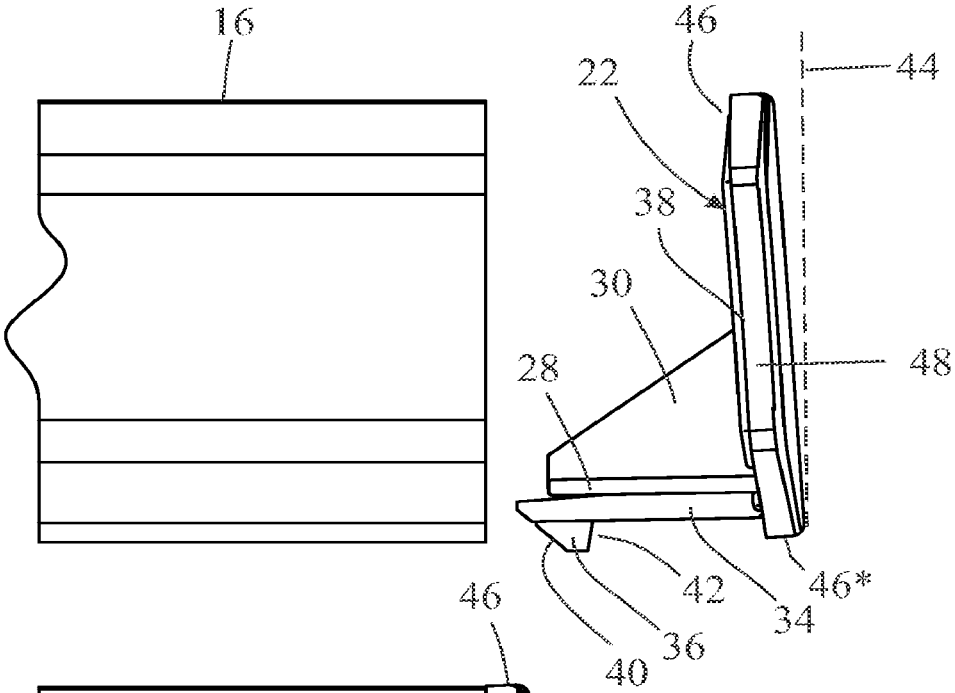
FIG. 6 is a broken away front view of the rail and end cap of FIG. 2 with the end cap aligned with the rail in preparation for installation onto the rail.

In addition to the previously described outriggers 30, a beam 34 projects from the inner surface of the end cap 22 in a horizontal direction substantially parallel to the wings 28 (See also FIG. 6). A projection 36 extends from the free end of the beam 34 toward the base wall 24. The projection 36 is sized and located such that it is received in the opening 32 in the rail 16 when the end cap 22 is snapped onto the rail 16, as described later. The projection 36 defines a sloped leading surface 40 (See FIG. 6) to ease the beam 34 onto the base wall 24 of the rail 16, and a slightly tapered shoulder 42 on the opposing surface of the projection 36 to pull the end cap 22 into the rail 16 and to lock the projection 36 into the opening 32 (See also FIGS. 4 and 5). The end cap 22 also includes an inwardly-projecting, discontinuous flange 38 extending along substantially the entire perimeter of the end cap 22 and spaced inwardly a short distance from the perimeter. This flange 38 fits inside the end of the rail 16, with the first and second opposed edges 48 and the third and fourth opposed edges 46, 46' of the end cap 22 abutting the end of the rail 16. The flange 38 provides a light stop to prevent light from passing completely through any small gaps that may exist between the end cap 22 and the end of the rail 16.

Referring to FIG. 6, the dotted vertical line 44 is perpendicular to the horizontal direction of the wings 28. It may be appreciated that the top edge 46 of the end cap 22 lies slightly forward of the dotted line 44, while the bottom edge 46* lies on the dotted line 44. As the end cap 22 is installed onto the rail 16 by sliding the wings 28 horizontally into the tracks 26 and pushing the end cap 22 against the rail 16 (See FIG. 7), the top edge 46 of the end cap 22 impacts first against the end of the rail 16.

Figure 7:
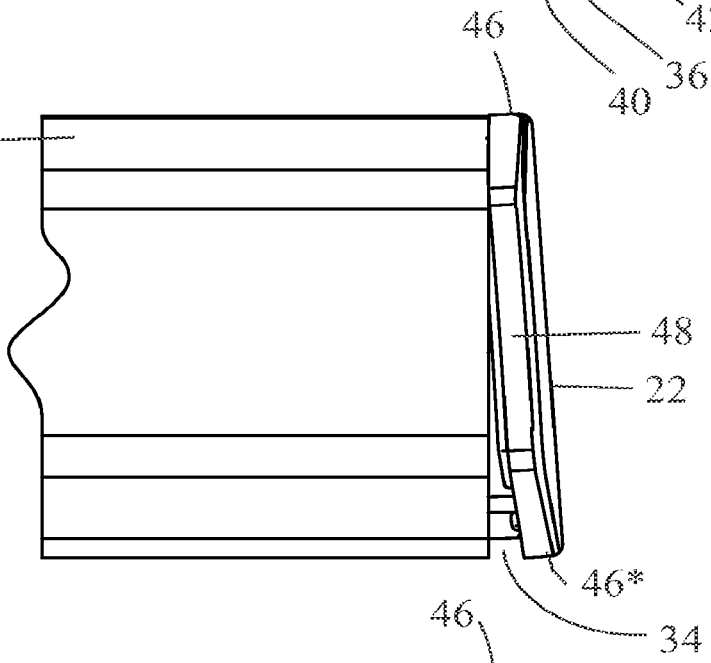
FIG. 7 is the same view as FIG. 6 but with the end cap partially installed onto the rail.
Figure 8:
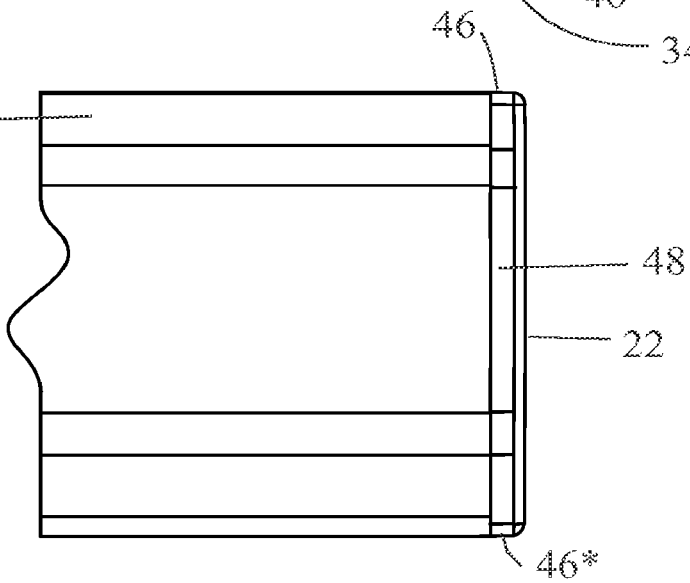
FIG. 8 is the same view as FIG. 7 but with the end cap fully installed onto the rail.

The end cap 22 is then pushed further into the rail 16 until the projection 36 on the beam 34 snaps into the opening 32 in the base wall 24 of the rail 16, which also coincides with the position where the end cap 22 fits tightly against the rail 16, as shown in FIG. 8. The wall 42 of the projection 36 abuts the wall of the opening 32, which is fixed relative to the rail 16, so the wall of the opening 32 serves as a retaining wall, providing a positive stop that prevents the end cap 22 from being pulled back out of the rail 16. The scale is distorted and the distance that the end cap 22 is pushed into the rail 16 between FIGS. 7 and 8 is exaggerated to illustrate the point.

It should be noted that the wall 42 of the projection 36 is slightly tapered relative to the wall of the opening 32, so that the beam 34 pulls the end cap 22 further toward the rail 16 as the projection 36 moves further into the opening 32.

In order to move the end cap from the position shown in FIG. 7 to the position shown in FIG. 8, the end cap pivots about the top edge 46 relative to the rail 16. This causes the wings 28 to push upwardly against the bottom surface of their respective tracks 26, which are fixed relative to the rail 16, wedging the wings 28 against the tracks 26. Even though the actual horizontal distance traveled is small, it is enough to wedge the wings 28 against their corresponding tracks 26 for a tight fit between the end cap 22 and the rail 16 and creates a tension in the end cap 22 which retains the end cap 22 on the rail 16 (See FIG. 8).

The beam 34 also exerts a downward force on the base wall 24 of the rail 16, which lifts the wings 28 upwardly against the tracks 26.

Figure 9:
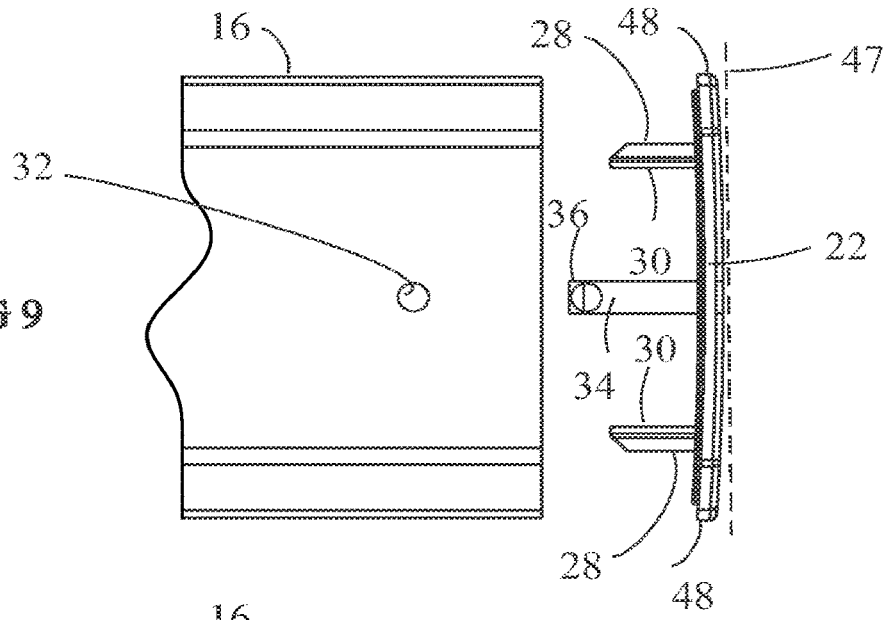
FIG. 9 is a view from the bottom, looking up, of the rail and end cap of FIG. 6.
Figure 10:
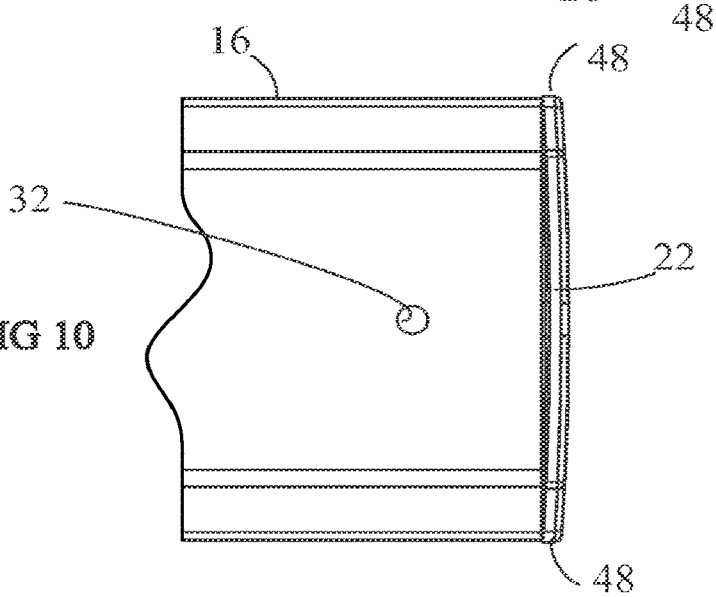
FIG. 10 is a view from the bottom, looking up, of the rail and end cap of FIG. 7.
Figure 11:
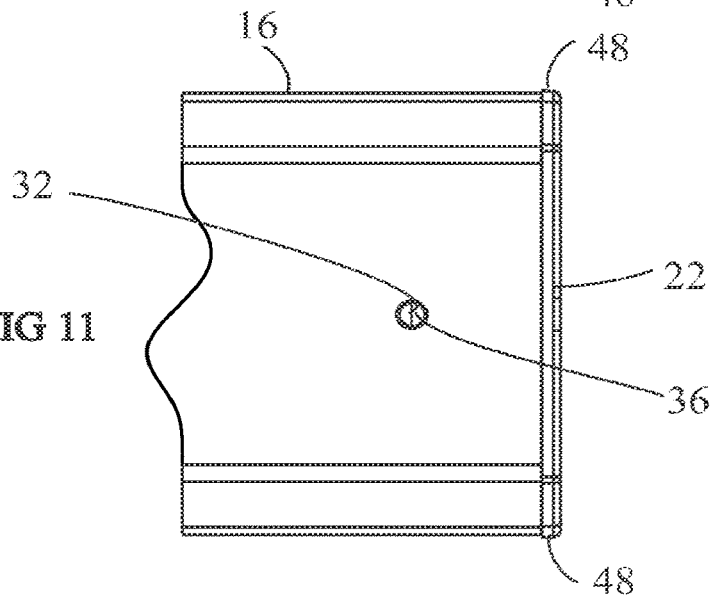
FIG. 11 is a view from the bottom, looking up, of he rail and end cap of FIG. 8.

Referring to FIG. 9, the dotted line 47 shows that, when at rest, the end cap 22 has a slightly arcuate shape. The front and rear edges (first and second opposed edges) 48 of the end cap 22 are located slightly inwardly, away from the dotted line 47 and toward the rail 16, and the central portion of the end cap 22, located between the opposed edges 48, is located further away from the rail 16. As the end cap 22 is installed onto the rail 16 by sliding the wings 28 into the tracks 26 and pushing the end cap 22 against the rail 16 (See FIG. 10), the edges 48 of the end cap 22 impact against the rail 16. The installer continues pushing the end cap 22 toward the rail 16, flattening the curvature of the end cap 22 until the projection 36 on the beam 34 snaps into the opening 32 in the base wall 24 of the rail 16, which also coincides with the position where the end cap 22 is flattened and fits tightly against the rail 16, as shown in FIG. 11.

Referring again to FIGS. 8 and 11, with the end cap 22 installed onto the rail 16, it may be appreciated that the end cap 22 lies flat against the end of the rail 16 and no longer displays the slight curvature or slanting away from either of the axes 44 and 47.

Figure 12:
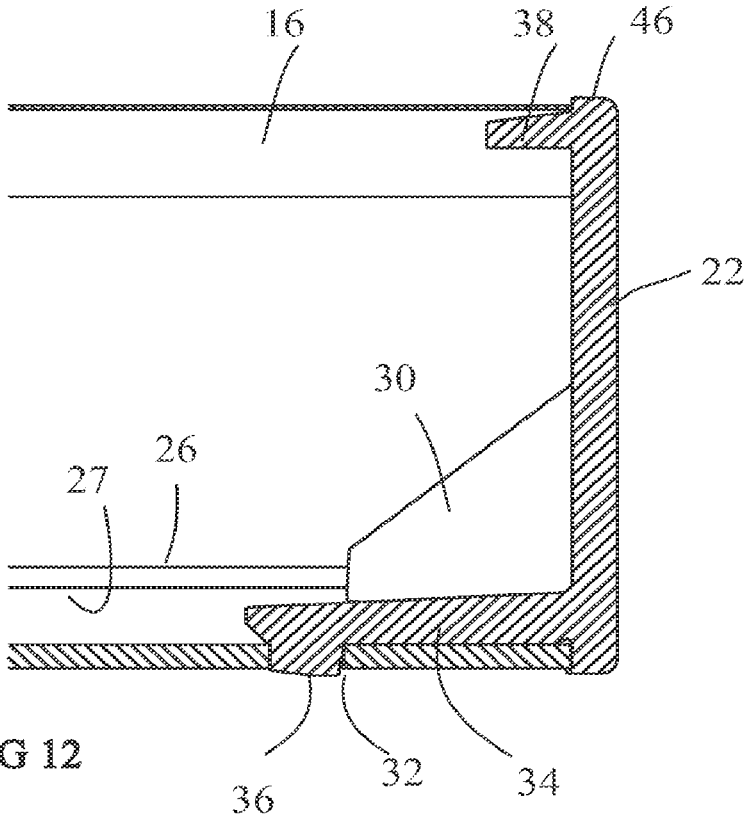
FIG. 12 is a view taken along the section 12-12 of FIG. 4.

As the end cap 22 is pushed inwardly into the end of the rail 16, the projection 36 on the beam 34 riding on the base wall 24 of the rail 16 causes the beam 34 to flex upwardly. As the projection 36 on the beam 34 slides past the vertical edge of the opening 32 on the base wall 24 of the rail 16, the beam 34 snaps back downwardly, and the projection 36 abuts the edge of the opening 32 (the retaining wall), providing a positive stop that secures the projection 36 in the opening 32. The beam 34 serves as a securement leg to keep the end cap 22 secured onto the rail 16 in a flattened condition. The wings 28 wedged in the tracks 26 also are abutting surfaces fixed relative to the rail 16 (i.e. the tracks 26) and serve as securement legs to keep the end cap 22 pulled snugly against the end of the rail 16 in a flattened condition. These securement legs 34, 28 act against the bias of the flattened end cap 22, which wants to return to its original, arcuate shape. The securement legs 34, 28 hold the end cap 22 tightly to the rail 16, under tension provided by the spring action of the flattened end cap 22. FIG. 12 shows the projection 36 on the beam 34 abutting the edge of the opening 32, which serves as a retaining wall.

To remove the end cap 22 from the rail 16, the user pushes upwardly on the projection 36 on the beam 34 until it clears the base wall 24 of the rail 16, and then grasps the end cap 22 and pulls outwardly. Once the projection 36 has cleared the opening 32, the end cap 22 may be pulled straight out. The end cap 22 may be reinstalled over and over again with no detrimental effect on its performance.

While this description refers to top, bottom, front and rear, it is understood that the rail 16 could be rotated so that the base wall 24, which is shown in this embodiment as being located at the bottom, becomes the front wall or the rear wall or the top wall, and the directions of the corresponding elements would change accordingly.

Figure 13:
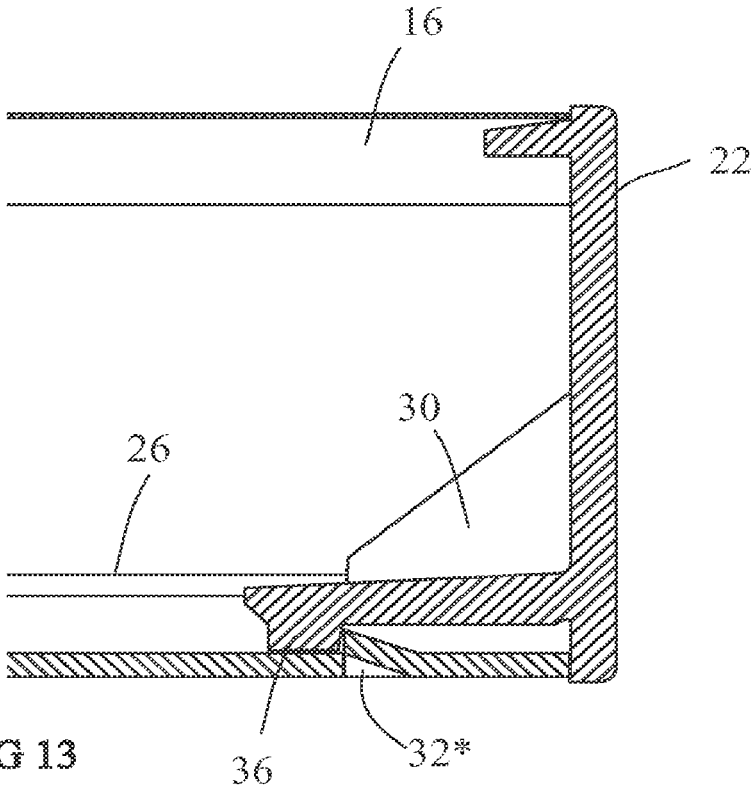
FIG. 13 is the same as FIG. 12 but for an alternative embodiment.

An alternative embodiment, shown in FIG. 13, is the same as the embodiment described above except that, instead of the opening 32, there is a body 32* projecting upwardly from the base wall 24 of the rail 16 in the same position as the opening 32. The body 32* has a vertical wall on an inner side, which is fixed relative to the rail 16 and serves as a retaining wall, such that, when the projection 36 passes over the body 32*, the projection 36 abuts the retaining wall on the body 32*, thereby having the same effect of providing a positive stop to secure the beam 34 in position on the rail 16. As was noted in the previous embodiment, there is a slight angle between the wall of the projection 36 and the abutting retaining wall, so that the beam 34 pulls the end cap 22 toward the end of the rail 16 as the projection 36 moves downwardly into the retaining wall on the body 32*.

While the body 32* in this embodiment is formed as part of the rail 16, it alternatively could be a separate member secured to the rail 16, in which case its retaining wall still would be fixed relative to the rail 16.

Figure 14:
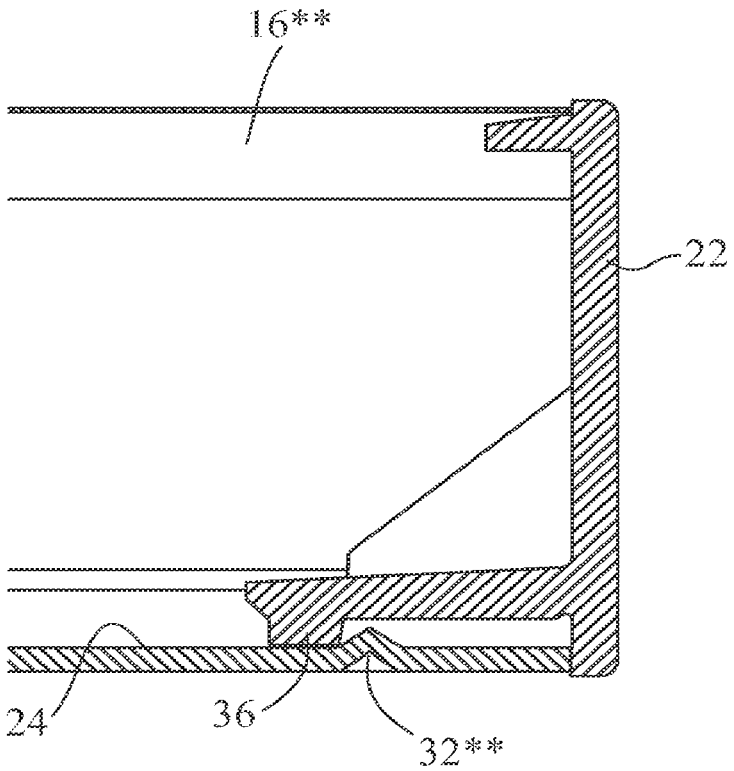
FIG. 14 is the same as FIG. 12 but for another alternative embodiment.

Another alternative embodiment shown in FIG. 14 includes a rail 16 which has a bump 32** (instead of an opening 32) formed on the base wall 24. The projection 36 passes over the bump 32**, which is a body projecting from the rail that provides an abutting retaining wall which is at an angle to the vertical. This angled retaining wall also causes the projection 36 to pull the end cap inwardly, toward the rail as the projection 36 passes over the bump 32****.

Another alternative embodiment (not shown) is the same as the first embodiment except that it has no opening 32 or body 32* on the rail 16 but simply relies upon the wedging of the beam 34 pushing downwardly on the base wail 24 and of the wings 28 pushing upwardly on the tracks 26 to secure the end cap on the rail 16 against the biasing force of the flattened end cap 22 which wants to return to its arcuate shape. This alternative embodiment has the advantage that no holes (such as the hole 32 of FIG. 12) or discontinuities (such as the dimple 32* or 32 of FIGS. 13 and 14 respectively) are seen by the user on the rail 16**.

FIGS. 15-23 show another embodiment of an end cap 22' and rail 16. The rail 16 is identical to the rail 16 described above except that there is no need for an opening 32 or bump 32. The end cap 22' is similar to the end cap 22 of FIG. 2 in that it has wings 28' distally mounted on outriggers 30'. However, in this embodiment, as best appreciated in FIG. 20, the outriggers 30' are not in contact with the end plate 22' but instead are cantilevered off of a beam 50 which is centrally connected along beam portions 52 to the end plate 22'. This allows the outriggers 30' to rotate slightly in the "z" direction (in the vertical direction, See FIG. 15) relative to the beam 50 and relative to the end plate 22'. This, in turn, permits the wings 28' to float up or down relative to the beam 50 as required. In this arrangement, the outriggers 30' and beam 50 form an "M" shaped profile, as best appreciated in FIG. 23, with the wings 28'** projecting outwardly from the free ends of the "M".

Figure 23:
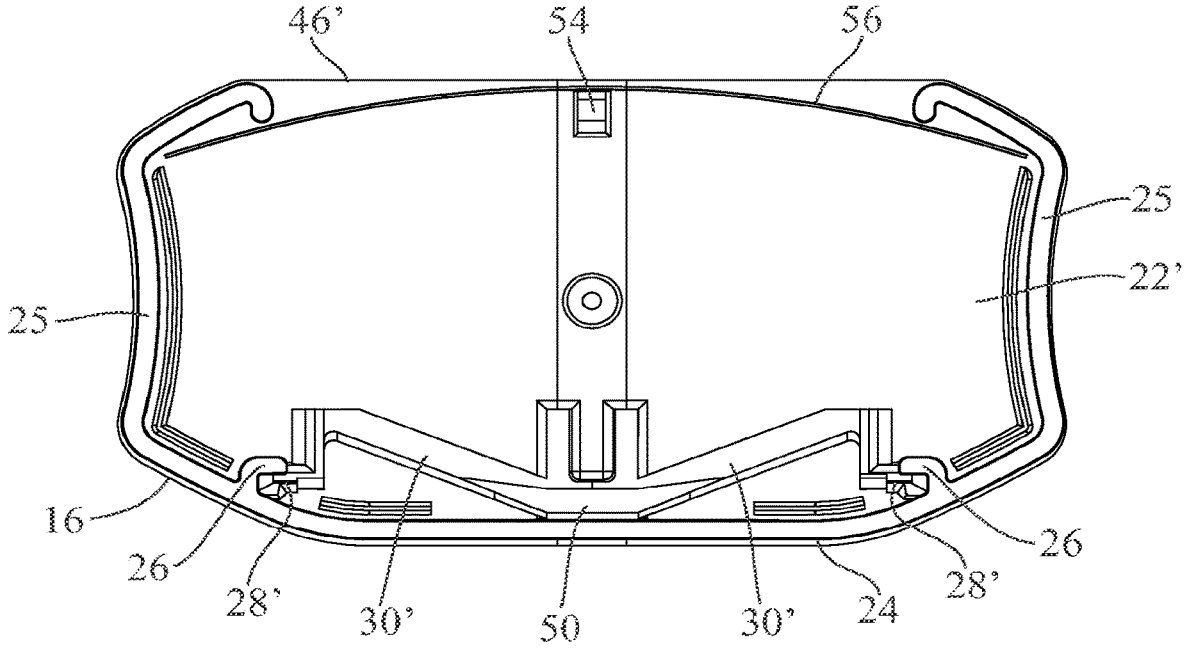
FIG. 23 is a section view along line 23-23 of FIG. 16, with a top plate added to dose up the top opening of the rail so as to hide any mechanism housed inside the rail.
Figure 24:
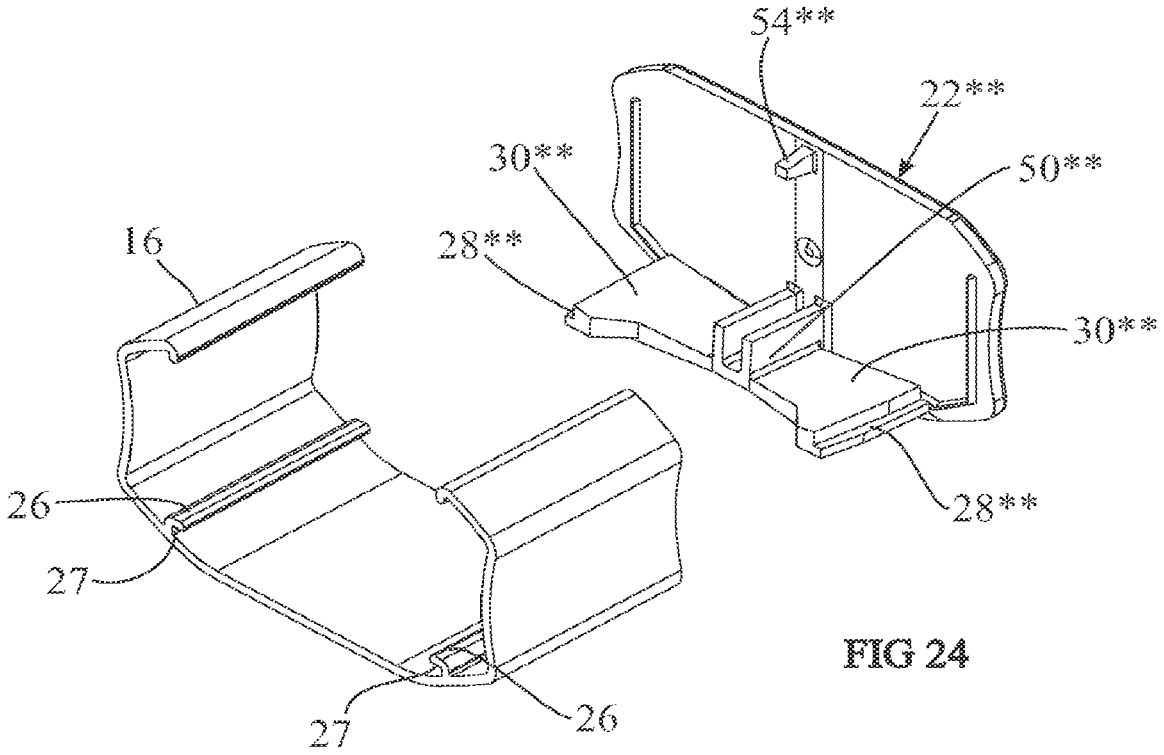
FIG. 24 is a perspective view of a rail and end cap for another alternative embodiment, with the rail broken away.
Figure 25:
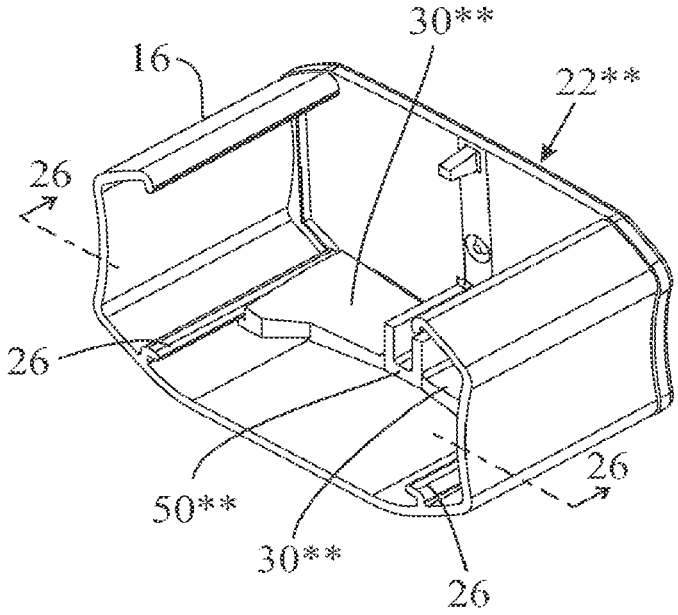
FIG. 25 is a perspective view of the assembled rail and end cap of FIG. 24, with the rail broken away.

As shown in FIG. 23, the beam 50 pushes against the bottom of the rail 16 when the end cap 22' is installed on the rail 16, serving as a securement leg, and the outwardly projecting wings 28' are received in the spaces 27 formed between the tracks 26 and the bottom surface of the rail 16, so each of the wings 28' (together with its respective outrigger 30') also serves as a securement leg. As the wings 28' engage the tracks 26, the wings 28' are wedged against the tracks 26 and are squeezed together, toward each other, in a squeezing direction. Squeezing the wings 28' together in this particular geometry lifts the beam 50 and the end cap 22' relative to the base of the rail 16 (i.e. moves the end cap in a direction perpendicular to the squeezing direction).

Figure 17:
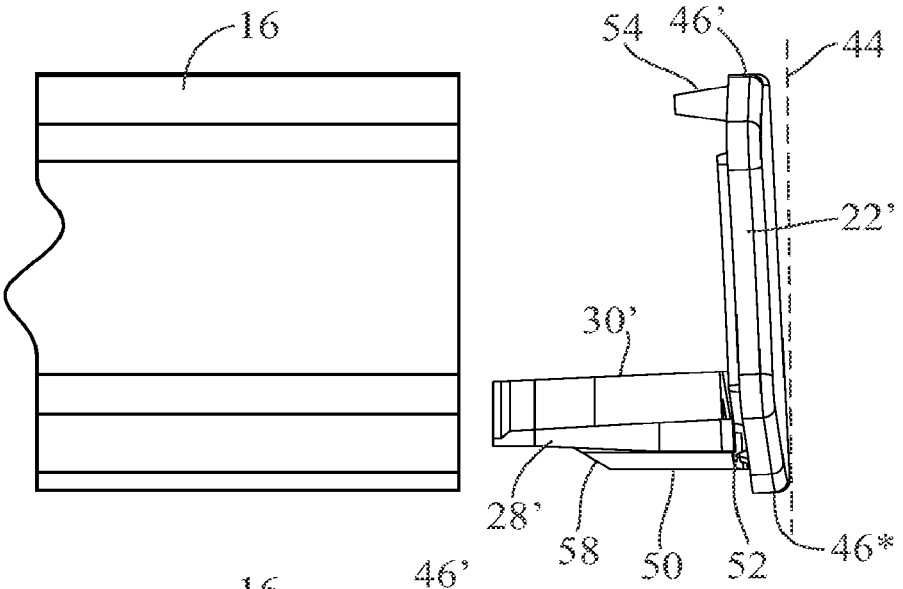
FIG. 17 is a broken away front view of the rail and end cap of FIG. 15 with the end cap aligned with the rail in preparation for installation onto the rail.

As shown in FIG. 17, the beam 50 has a tapered front edge 58, which eases the beam 50 into the inside of the rail 16.

Figure 15:
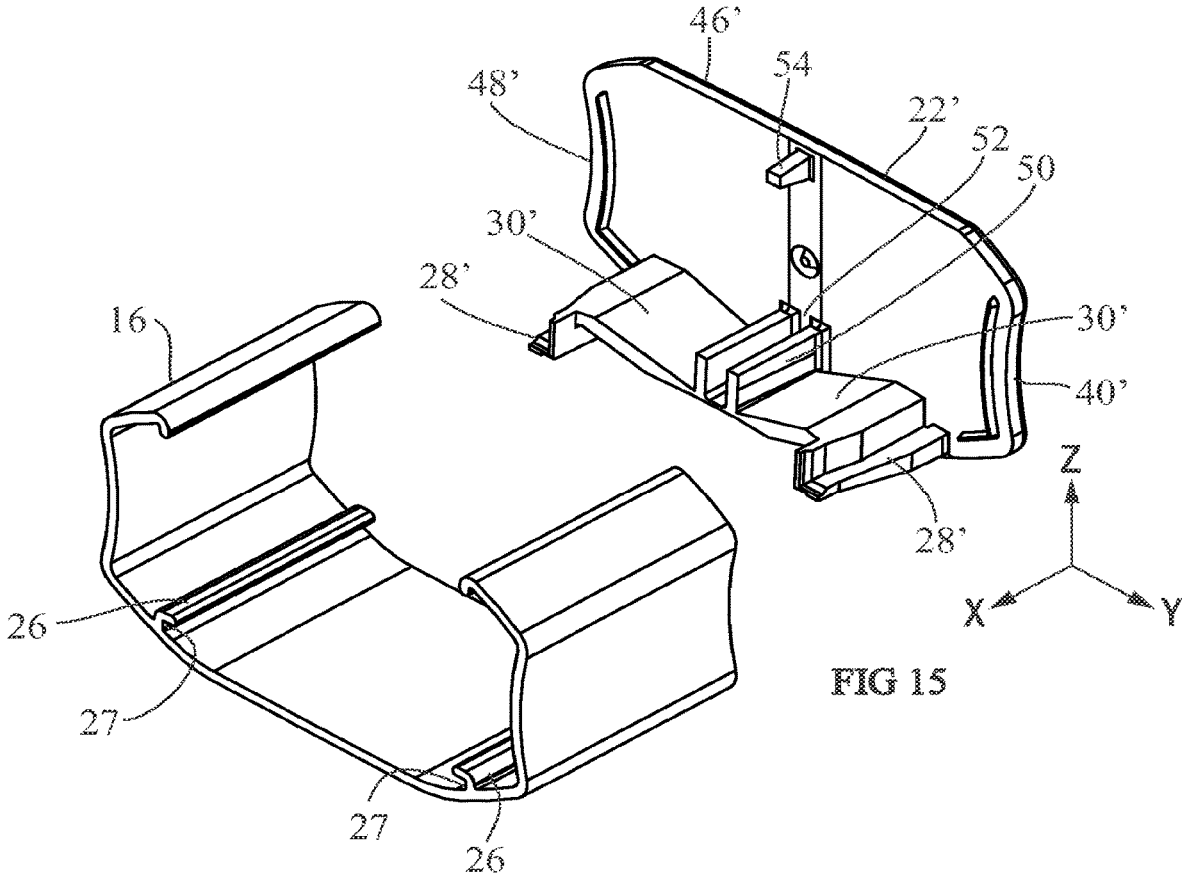
FIG. 15 is a perspective view of a rail and end cap for yet another alternative embodiment, with the rail broken away.

The wings 28' are parallel to each other and are mirror images of each other. As shown in FIG. 15, the wings 28' are tapered in both the "x" and "z" directions, which helps the wings 28' enter into the spaces 27 beneath and between the tracks 26 and helps cause the deflection of the outriggers 30'. As shown in FIG. 17, the top surfaces of the wings 28' are at a lower elevation at the end directed toward the rail 16 and taper to a higher elevation at the end adjacent to the end cap 22'. As shown in FIG. 15, the outer surfaces of the wings 28' are closer together at the end directed toward the rail 16 and taper further outwardly in the "y" direction as they approach the end cap 22', which helps the wings 28' enter easily into the spaces 27 beneath and between the tracks 26.

Figure 18:
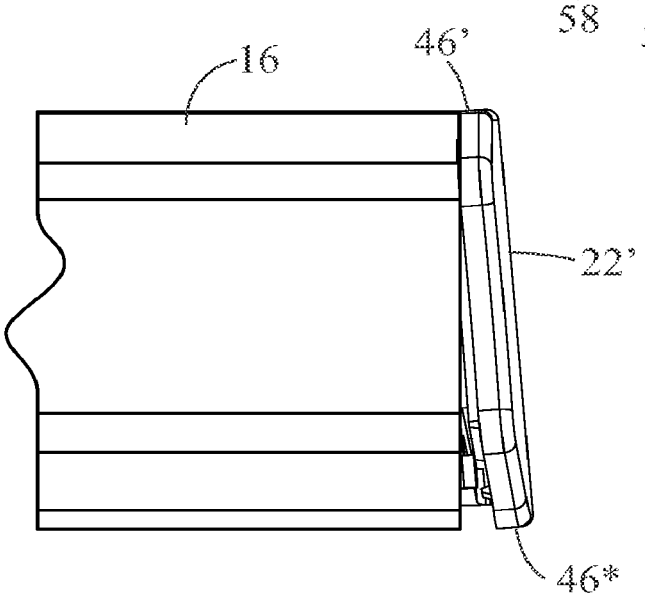
FIG. 18 is the same view as FIG. 17 but with the end cap partially in lied onto the rail.

Referring to FIG. 17, the dotted vertical line 44 is perpendicular to the horizontal direction of the wings 28'. It may be appreciated that the top edge 46' of the end cap 22 lies slightly forward of the dotted line 44, while the bottom edge 46* lies on the dotted line 44. As the end cap 22' is installed onto the rail 16 by sliding the wings 28' horizontally into the tracks 26 and pushing the end cap 22' against the rail 16, the top edge 46' of the end cap 22' impacts first against the end of the rail 16, as shown in FIG. 18. The end cap 22' is then pushed further into the rail 16 until the end cap 22' fits tightly against the rail 16, with all four edges of the end cap abutting the flat end of the rail, as shown in FIG. 19.

Figure 19:
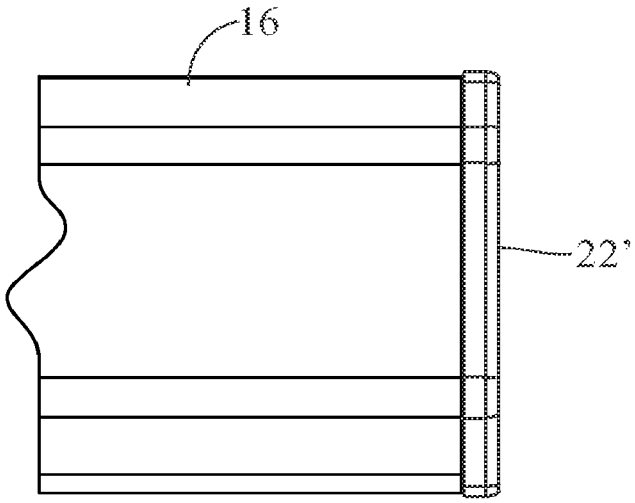
FIG. 19 is the same view as FIG. 18 but with the end cap fully installed onto the rail.

In order to move the end cap 22' from the position shown in FIG. 18 to the position shown in FIG. 19, the end cap 22' pivots about the top edge 46' relative to the rail 16. This pivoting causes the wings 28' to wedge tightly into the space 27 between the tracks 26 and the rail 16 such that the end cap 22' is held snugly against the rail 16 and cannot accidentally be pried off. Thus, the wings 28' serve as securement legs.

Figure 20:
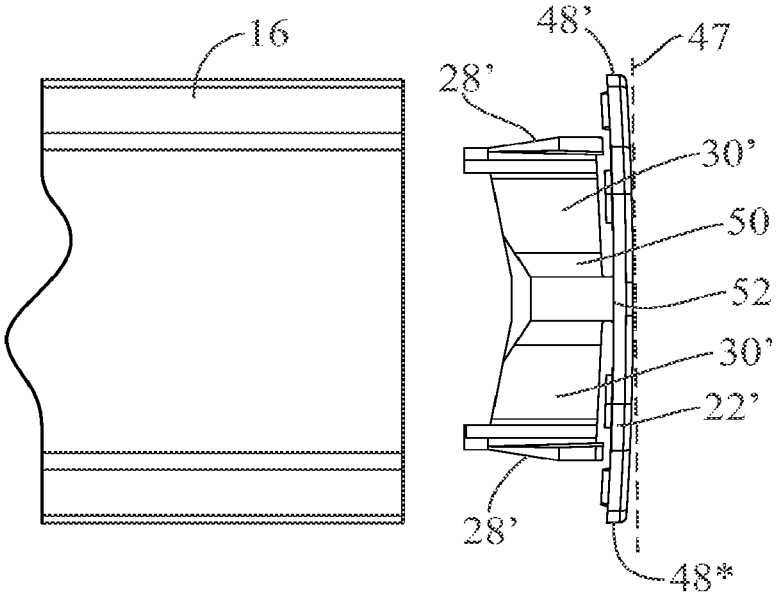
FIG. 20 is a view from the bottom, looking up, of the rail and end cap of FIG. 17.
Figure 21:
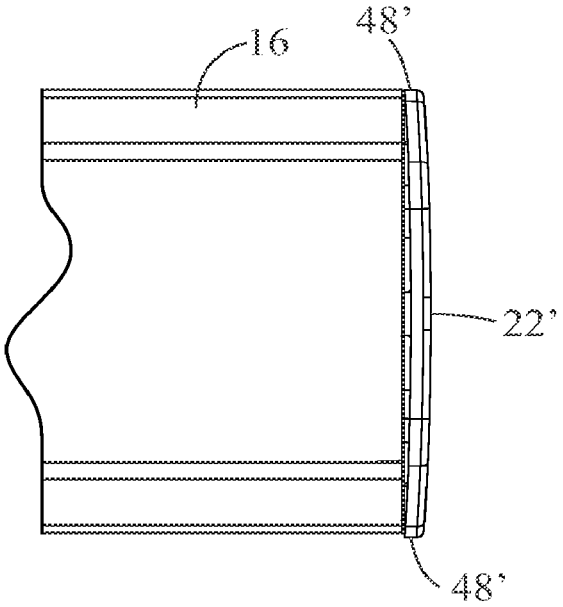
FIG. 21 is a view from the bottom, looking up, of the rail and end cap of FIG. 18.
Figure 22:
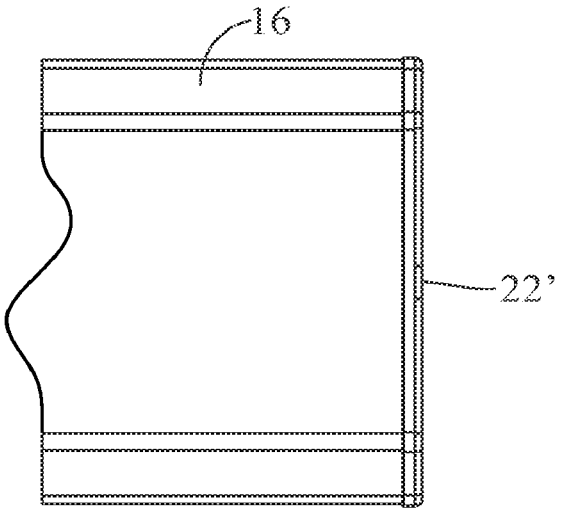
FIG. 22 is a view from the bottom, looking up, of the rail and end cap of FIG. 19.

Referring to FIG. 20, the dotted line 47 shows that, when at rest, the end cap 22' has a slightly arcuate shape. The front and rear edges (first and second opposed edges) 48' of the end cap 22' are located slightly inwardly, away from the dotted line 47 and toward the rail 16, and the central portion of the end cap 22', located between the opposed edges 48', is located further away from the rail 16. As the end cap 22' is installed onto the rail 16 by sliding the outwardly projecting wings 28' under the tracks 26 and pushing the end cap 22' against the rail 16, the front and rear edges 48' of the end cap 22' impact against the rail 16, as shown in FIG. 21. The installer continues pushing the end cap 22' toward the rail 16, flattening the curvature of the end cap 22' until the end cap 22' is flattened and fits tightly against the rail 16, as shown in FIG. 22. This flattening of the end cap 22' results in a spring force which helps retain the end cap 22' on the rail 16.

Referring again to FIGS. 19 and 22, with the end cap 22' installed onto the rail 16, it may be appreciated that the end cap 22' lies flat against the end of the rail 16 and no longer displays the slight curvature or slanting away from either of the axes 44 and 47.

Figure 16:
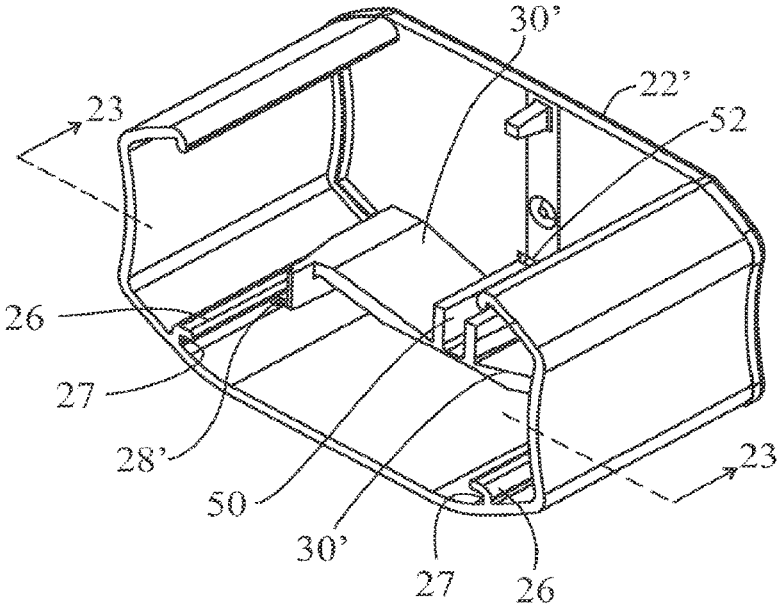
FIG. 16 is a perspective view of the assembled rail and end cap of FIG. 15, with the rail broken away.

FIG. 23 is a section view along line 23-23 of FIG. 16, showing the end cap 22' mounted on the rail 16. It may be appreciated that there is a projection 54 adjacent the top edge 46' of the end cap 22', and intermediate the front and rear edges 48' of the end cap 22'. This projection 54 provides a support surface for an arcuate plate 56, which is wedged between the two elongated legs 25 of the rail 16 (See FIG. 2) projecting away from the base wall 24 of the rail 16. This arcuate plate 56 spans the opening of the rail 16 so as to cover and hide any mechanism housed inside the rail 16.

Figure 26:
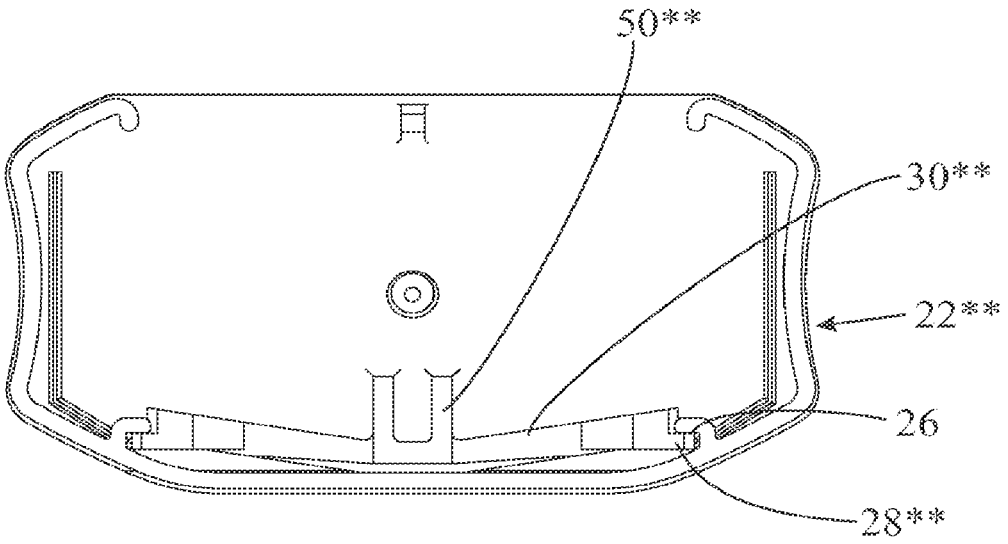
FIG. 26 is a section view along line 26-26 of FIG. 25.

FIGS. 24-30 show other embodiments of an end cap 22 which have a higher holding power than the end cap 22' described above, and in which the degree of holding power can be fine-tuned as desired. Comparing the end cap 22' of FIG. 23 with the end cap 22** of FIGS. 2427 (especially as seen in FIG. 26), it may be appreciated that the beam 50**, outriggers 30** and wings 28** of this end cap 22** forms a more flattened-out, bow-shaped profile as compared with the "M" shaped profile formed by the beam 50, outriggers 30 and wings 28' of the previous end cap 22'. As in the previous embodiment, the outriggers 30** are cantilevered from the beam 50**, and the wings 28** are distally mounted on the outriggers 30****.

In the geometry of this embodiment, the end cap 22moves toward the base of the rail 26 as the end cap 22** is installed onto the rail 26 and the wings 28** are squeezed together (again moving perpendicularly to the squeezing direction). This causes the beam 50** to press against the base of the rail 26. The downward force of the beam 50** against the bottom of the rail, and the counteracting upward force of the wings 28** against the bottom of the track 26 provide additional friction and a higher degree of grip of the end cap 22** on the rail 16 than in the previous end cap 22'**.

It should be noted that the amount of movement of the outriggers 30 is very small, and the degree of interference fit of the wings 28** between the tracks 26 and the rail 16 is also very small. However, the spring force provided by the outriggers 30** and the spring force caused by the deformation of the end cap 22** as it is installed on the rail (flattening from the arcuate shape shown in FIG. 20 to a flat shape shown in FIG. 22) allow for numerous removals and reinstallations of the end cap 22** onto the rail 16 without the end cap 22** losing its gripping force on the rail 16. The end cap 22** continues to hold well on the end of the rail 16** even after many removals and reinstallations.

FIGS. 28-30 show a further modification to the end cap 22. This modification involves cutting out notches 58** from the rear edge of each of the outriggers 30**. These notches 58** allow greater flexing of the rear portion of the wings 28** relative to the beam 50**, which reduces the wedging between the wings 28** and the rail 16. This reduces the degree of holding power between the end cap 22** and the rail 16 as compared with the embodiment of FIGS. 24-27. The amount of holding power can be adjusted by adjusting the length of the notches 58** from the rear edge of the outriggers 30****.

Figure 27:
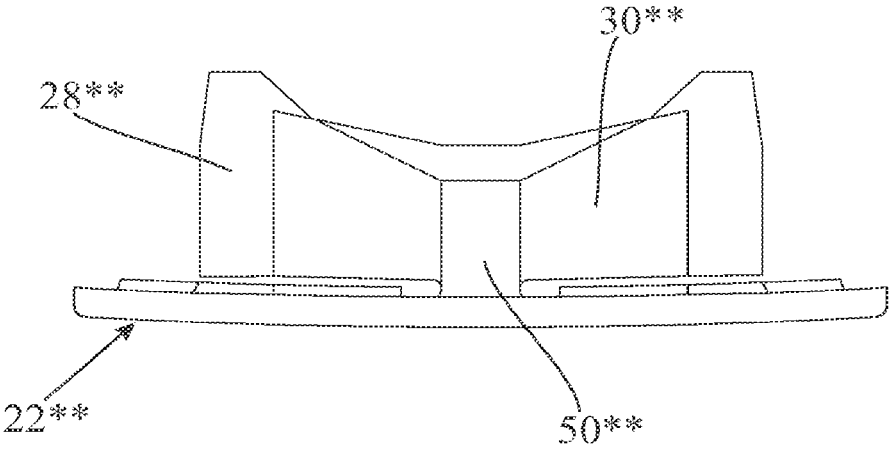
FIG. 27 is a plan view of the end cap of FIG. 24.

It should be noted that the end cap 22 may be manufactured with the notches 58** already present instead of cutting out these notches 58** off of the end cap 22** of FIGS. 26 and 27. It should also be noted that the length of these notches 58** may be varied from zero (essentially no notches present, as shown in FIGS. 24-27) which maximizes the degree of holding power for this embodiment of the end cap 22**, to whatever length is needed to obtain the desired degree of holding power; the longer the length of the notches 58**, the lower the degree of holding power. Furthermore, there may be a notch 58** in only one of the outriggers 30. Also, while the embodiment of FIG. 28 has identical notches that are mirror images of each other, the notches 58** may have different lengths or have different profiles in order to obtain just the desired amount of holding power. Finally, the notches 58** may be replaced by, or used in conjunction with, changes in thickness of the outriggers 30** adjacent to the wings 28**, providing the wings 28** with more flexibility relative to the beam 50** adjacent to the rear edge of the wings 28** and ultimately reducing the holding power of the end cap 22****.

It is understood that the installation and removal of this end cap 22 is essentially identical to that of the end cap 22'** described earlier.

While the embodiments described above are for an end cap secured to the right end of the rail, it is understood that a mirror image end cap would be used on the left end of the rail.

It will be obvious to those skilled in the art that modifications may be made to the embodiments described above without departing from the scope of the present invention as claimed.

What is claimed is:

1. An arrangement for a covering for an architectural opening, said arrangement comprising:

an elongated rail extending in a longitudinal direction, said rail having an elongated base wall and elongated legs projecting away from said base wall, said rail defining an end and including at least one track projecting away from an inner surface of said base wall at a location between said elongated legs;

an end cap configured to be coupled to said end of said rail, said end cap including first and second opposed edges and a wall extending between said first and second edges along a widthwise direction of said end cap;

a beam coupled to and extending away from said wall of said end cap between said first and second opposed edges of said end cap, said beam being configured to extend adjacent to said base wall of said rail when said end cap is installed relative to said end of said rail; and at least one outrigger separate from said beam, said at least one outrigger coupled to and extending away from said wall of said end cap at a location between said beam and at least one of said first edge or said second edge of said end cap in the widthwise direction of said end cap, said at least one outrigger including an outrigger wall and a wing extending from said outrigger wall, said wing configured to be received within said at least one track of said rail and said outrigger wall configured to be positioned outside of said at least one track when said end cap is installed relative to said end of said rail.

2. The arrangement of claim 1, wherein:

said beam extends away from said wall of said end cap to a free end of said beam; and said beam includes a projection at or adjacent to said free end that extends from said beam towards said inner surface of said base wall of said rail.

3. The arrangement of claim 2, wherein said projection of said beam abuts a retaining wall associated with said base wall of said rail to provide a positive stop for said beam when said end cap is installed relative to said end of said rail.

4. The arrangement of claim 3, wherein:

said retaining wall is defined by an edge of said base wall positioned at an opening defined in said base wall of said rail; and said projection of said beam is received within said opening of said base wall hen said end cap is installed relative to said end of said rail.

5. The arrangement of claim 3, wherein:

said retaining wall is defined by a body projecting outwardly from said inner surface of said rail; and said projection engages said body when said end cap is installed relative to said end of said rail.

6. The arrangement of claim 3, wherein a tapered surface is defined by at least one of said projection of said beam or said retaining wall that serves to pull said end cap against said end of said rail as said projection engages said retaining wall.

7. The arrangement of claim 1, wherein:

said wall of said end cap defines an arcuate shape between said first and second edges of said end cap prior to installation of said end cap relative to said end of said rail such that said first and second edges are offset from a central portion of said wall; and said arcuate shape of said wall is flattened out as said end cap is pushed against said end of said rail and at least one of said beam or said at least one outrigger a portion of said rail such that a spring force is applied through said wall that maintains said end cap tightly against said end of said rail.

8. The arrangement of claim 1, wherein:

said end cap further includes third and fourth opposed edges;

at least one of said beam or said at least one outrigger extends away from said wall of said end cap along a lengthwise direction to a free end spaced apart from said wall;

prior to installation of said end cap relative to said end of said rail, said wall of said end cap is angled relative to a reference plane extending perpendicular to said lengthwise direction and passing through said third edge of said end cap such that said fourth edge of said end cap is offset from said reference plane; and when said end cap is installed relative to said end of said rail, said fourth edge of said end cap moves closer to said reference plane as said end cap is pushed against said end of said rail and said at least one of said beam or said at least one outrigger engages a portion of said rail.

9. The arrangement of claim 1, wherein: said at least one track comprises first and second tracks projecting away from said inner surface of said base wall; and said at least one outrigger comprises a first outrigger coupled to and extending away from said wall of said end cap at a location between said beam and said first edge of said end cap; said at least one outrigger further comprises a second outrigger coupled to and extending away from said wall of said end cap at a location between said beam arid said second edge of said end cap; and said first outrigger is configured to be at least partially received within said first track and a second outrigger configured to be at least partially received within said second track.

10. The arrangement of claim 9, wherein: said first outrigger includes a first outrigger wall and a first wing extending from said first outrigger wall, with said first wing configured to be received within said first track of said rail and said first outrigger wall configured to be positioned outside of said first track when said end cap is installed relative to said end of said rail; and said second outrigger includes a second outrigger wall and a second wing extending from said second outrigger wall, with said second wing configured to be received within said second track of said rail and said second outrigger wall configured to be positioned outside of said second track when said end cap is installed relative to said end of said rail.

11. The arrangement of claim 10 wherein:

said first wing is configured to be received within a space defined between a first portion of said first track and said inner surface of said base wall; and said second wing is configured to be received within a space defined between a second portion of said second track and said inner surface of said base wall.

12. The arrangement of claim 11, wherein:

said first wing is biased away from said inner surface of said base wall and into contact with said first portion of said first track when said end cap is installed relative to said end of said rail; and said second wing is biased away from said inner surface of said base wall and into contact with said second portion of said second track when said end cap is installed relative to said end of said rail.

13. An arrangement for a covering for an architectural opening, said arrangement comprising:

an elongated rail extending in a longitudinal direction, said rail having an elongated base wall and first and second legs projecting away from said base wall, said rail defining an end and including at least one track projecting away from an inner surface of said base wall at a location between said elongated legs;

an end cap configured to be coupled to said end of said rail, said end cap including first and second opposed edges and a wall extending between said first and second edges along a widthwise direction of said end cap, said first edge configured to extend along said first leg of said rail and said second edge configured to extend along said second leg of said rail when said end cap is installed relative to said end of said rail, said wall defining an arcuate shape between said first and second edges of said end cap prior to installation of said end cap relative to said end of said rail such that said first and second edges are offset from a central portion of said wall;

a beam coupled to and extending away from said wall of said end cap between said first and second opposed edges of said end cap, said beam being configured to extend adjacent to said base wall of said rail when said end cap is installed relative to said end of said rail; and at least one outrigger separate and spaced apart from said beam in the widthwise direction of said end cap such that said at least one outrigger is disposed between said beam and at least one of said first edge or said second edge of said end cap, said at least one outrigger including a wing configured to be received in said at least one track when said end cap is installed relative to said end of said rail;

wherein said arcuate shape of said wall is flattened out as said end cap is pushed against said end of said rail and at least one of said beam or said at least one outrigger engages a portion of said rail such that a spring force is applied through said wall that maintains said end cap tightly against said end of said rail.

14. The arrangement of claim 13, wherein:

said at least one track comprises both a first track and a second track projecting away from said inner surface of said base wall;

said at least one outrigger comprises both a first outrigger configured to be received within said first track and a second outrigger configured to be received within said second track;

said first outrigger is coupled to and extends away from said wall of said end cap at a location between said beam and said first edge of said end cap in the widthwise direction of said end cap; and said second outrigger is coupled to and extending away from said wall of said end cap at a location between said beam and said second edge of said end cap in the widthwise direction of said end cap.

15. The arrangement of claim 13, wherein:

said beam extends away from said wall of said end cap to a free end of said beam; and said beam includes a projection at or adjacent to said free end that extends towards said inner surface of said base wall of said rail.

16. The arrangement of claim 15, wherein said projection of said beam abuts a retaining wall associated with said base wall of said rail to provide a positive stop for said beam when said end cap is installed relative to said end of said rail.

17. The arrangement of claim 13, wherein:

said end cap further includes third and fourth opposed edges;

at least one of said beam or said at least one outrigger extends away from said wall of said end cap along a lengthwise direction to a free end spaced apart from said wall;

prior to installation of said end cap relative to said end of said rail, said wall of said end cap is angled relative to a reference plane extending perpendicular to said lengthwise direction and passing through said third edge of said end cap such that said fourth edge of said end cap is offset from said reference plane; and when said end cap is installed relative to said end of said rail, said fourth edge of said end cap moves closer to said reference plane as said end cap is pushed against said end of said rail and said at least one of said beam, said first outrigger, or said second outrigger engages a portion of said rail.

18. An arrangement for a covering for an architectural opening, said arrangement comprising:

an elongated rail extending in a longitudinal direction, said rail having an elongated base wall and elongated legs projecting away from said base wall, said rail defining an end and including first and second tracks projecting away from an inner surface of said base wall at a location between said elongated legs;

an end cap configured to be coupled to said end of said rail, said end cap including first and second opposed edges and a wall extending between said first and second edges along a widthwise direction of said end cap;

a beam coupled to and extending away from said wall of said end cap between said first and second opposed edges of said end cap, said beam being configured to extend adjacent to said base wall of said rail when said end cap is installed relative to said end of said rail;

a first outrigger cantilevered off of said beam towards said first edge of said end cap, said first outrigger including a first leg portion extending towards said first edge of said end cap at an angle such that a distance defined between said first leg portion and said inner surface of said base wall increases as said first leg portion extends away from said beam, said first outrigger further including a first wing portion configured to be received within said first track such that said first wing portion is retained within a space defined between said first track and said inner surface of said base wall; and a second outrigger cantilevered off of said beam towards said second edge of said end cap, said second outrigger including a second leg portion extending towards said second edge of said end cap at an angle such that a distance defined between said second leg portion and said inner surface of said base wall increases as said second leg portion extends away from said beam, said second outrigger further including a second wing portion configured to be received within said second track such that said second wing portion is retained within a space defined between said second track and said inner surface of said base wall.

19. The arrangement of claim 18, wherein:

said first outrigger further comprises a first connector portion extending between said first leg portion and said first wing portion; and said second outrigger further comprises a second connector portion extending between said second leg portion and said second wing portion.

20. The arrangement of claim 19, wherein:

said first wing portion is positioned closer to said inner surface of said base wall than an end of said first leg portion from which said first connector portion extends such that said first connector portion extends towards said inner surface of said base wall from said first leg portion to said first wing portion; and said second wing portion is positioned closer to said inner surface of said base wall than an end of said second leg portion from which said second connector portion extends such that said second connector portion extends towards said inner surface of said base wall from said second leg portion to said second wing portion.

21. The arrangement of claim 18, wherein:

said first and second outriggers are configured to flex relative to said beam; and when said end cap is being installed relative to said end of said rail, said first and second outriggers engage said first and second tracks, respectively, such that said first and second outriggers flex toward each other in a squeezing direction that causes said end cap to move relative to said rail in a direction perpendicular to the squeezing direction.

22. The arrangement of claim 21, wherein movement of said end cap in the direction perpendicular to the squeezing direction causes said beam to move toward and press against said inner surface of said base wall.

* * * * *